US008439105B2

(12) United States Patent
Ring

(10) Patent No.: US 8,439,105 B2
(45) Date of Patent: May 14, 2013

(54) COMPLETION SYSTEM FOR SUBSURFACE EQUIPMENT

(75) Inventor: Gary Allen Ring, Collinsville, TX (US)

(73) Assignee: Geotek Energy, LLC, Frisco, TX (US)

( * ) Notice: Subject to any disclaimer, the term of this patent is extended or adjusted under 35 U.S.C. 154(b) by 728 days.

(21) Appl. No.: 12/510,978

(22) Filed: Jul. 28, 2009

(65) Prior Publication Data

US 2011/0024102 A1 Feb. 3, 2011

(51) Int. Cl.
*E21B 36/00* (2006.01)
*E21B 17/00* (2006.01)

(52) U.S. Cl.
USPC ..... 166/57; 166/236; 166/242.1; 166/302

(58) Field of Classification Search ..... 166/57, 166/236, 242.1
See application file for complete search history.

(56) References Cited

U.S. PATENT DOCUMENTS 3,187,814 A 6/1965 McCarthy
3,824,793 A 7/1974 Matthews
3,938,334 A 2/1976 Matthews
3,939,659 A 2/1976 Matthews
3,967,448 A 7/1976 Matthews
3,988,896 A 11/1976 Matthews
4,025,240 A 5/1977 Matthews
4,050,517 A 9/1977 Matthews
4,059,959 A 11/1977 Matthews
4,066,995 A 1/1978 Matthews
4,077,220 A 3/1978 Matthews
4,125,289 A * 11/1978 Huff et al. ..... 299/4
4,142,108 A 2/1979 Matthews
4,325,681 A 4/1982 Matthews
4,328,673 A 5/1982 Matthews
4,342,197 A 8/1982 Matthews
4,377,763 A * 3/1983 Drake ..... 310/87
4,380,903 A 4/1983 Matthews
4,388,807 A 6/1983 Matthews
4,426,849 A * 1/1984 Matthews ..... 60/641.4
4,566,532 A 1/1986 Basmajian
4,605,977 A 8/1986 Matthews
4,776,169 A * 10/1988 Coles, Jr. ..... 60/641.2
4,900,433 A 2/1990 Dean et al.
5,052,482 A * 10/1991 Gondouin ..... 166/50
5,579,838 A 12/1996 Michael
5,816,325 A * 10/1998 Hytken ..... 166/303
5,862,866 A 1/1999 Springer (Continued)

OTHER PUBLICATIONS

PCT International Search Report and Written Opinion of the International Searching Authority, mailed Sep. 23, 2010 in PCT US2010/043439.

(Continued)

*Primary Examiner* — Jennifer H Gay
(74) *Attorney, Agent, or Firm* — Fitzpatrick, Cella, Harper & Scinto

(57) ABSTRACT

An apparatus for creating multiple and isolated well flow paths operating at different pressures in the wellbore is described. These multiple flow paths establish a full circulation loop with the surface and a remaining isolated flow channel produces reservoir fluids to the surface. Heat is transferred from the produced reservoir fluid into the circulated loop via a unique down-hole heat exchanger. The flow of reservoir fluid through the isolated annular well channel allows for more efficient and extensive extraction of heat from the reservoir fluid compared with merely heating the circulating loop via the well bore exterior surface.

12 Claims, 15 Drawing Sheets

U.S. PATENT DOCUMENTS

| | | | | |
|---|---|---|---|---|
| 6,073,448 | A | 6/2000 | Lozada | |
| 6,082,452 | A | 7/2000 | Shaw et al. | |
| 6,994,160 | B2 | 2/2006 | Wellington et al. | |
| 7,500,528 | B2 | 3/2009 | McKinzie et al. | |
| 2007/0071660 | A1 * | 3/2007 | McGrew | 422/196 |

OTHER PUBLICATIONS

Power Tube, Product Info, http://www.powertubeinc.com/product_info/, last retrieved on Dec. 27, 2011, archived Apr. 17, 2009, archived at http://web.archive.org/web/20090417174844/http://www.powertubeinc.com/product_info/, 2 pages.

Multi-Stage Pump In-Line (tandem) Versus Opposed Impeller Arrangements. Ekwestrel Corp., Engineering Consulting Services, Apr. 27, 2011. Last retrieved on Oct. 6, 2011, 2 pages.

Notification Concerning Transmitted of International Preliminary Report on Patentability and International Preliminary Report on Patentability in PCT/US2010/043439, mailed Feb. 9, 2012.

"Component Development", Sperry Low Temperature Geothermal Conversion System—Phase 1, Contract No. DE-AC03-78ET27125, Fig. 15 and Appendix H "Double Tubesheet Leak Test"; Harvey, C; McBee, W; and Matthews, H, Jul. 25, 1980.

"Systems Description", Sperry Low Temperature Geothermal Conversion System—Phase 1, Contract No. DE-AC03-78ET27125, Matthews, H, Jan. 1, 1984.

* cited by examiner

COMPLETION SYSTEM FOR SUBSURFACE EQUIPMENT

BACKGROUND

1. Field of the Invention

The present invention relates generally to subsurface equipment for fluid production wells and more particularly to managing fluid flow in annular flow channels.

2. Description of the Related Art

Wellbores are often provided with separate multiple flow channels for moving fluids into and out of subsurface reservoirs. For example, a single injection well may be required to provide injection fluids to two or more layers in a reservoir in which case two separate flow channels are required. As another example, a single wellbore may be used to provide both a means for producing fluid from a reservoir and also provide a supply and return conduit for supplying a working fluid to a subsurface device.

One way of separating the flow channels is to use separate tubing strings in parallel and placed into a single wellbore. This method is useful for shallow wells having low flow rates but is impractical for wells having higher flow rates or deep wells where pressure drops caused by the required narrow tubing strings are unacceptable. Instead, concentric tubing strings are used wherein one or more tubing strings are nested one inside another creating multiple annular flow channels defined by the inner wall of a first tubing string and the outer wall of a second tubing string passing through the annulus of the first tubing string. As the annular flow channels are separated by the tubing walls, the annular flow channels are isolated from one another in regard to pressure and the exchange of fluids. In addition, insulated tubing strings may also provide some thermal isolation between the annular flow channels.

One problem associated with concentric tubing strings is that the assignment of the fluids in each annular fluid channel is typically fixed. That is, once a fluid enters one of the annular flow channels, it must remain in that annular fluid channel and cannot be switched with fluid from another annular fluid channel. This may cause a problem, for example, when a subsurface device, such as turbine driven pump, needs to be placed in the wellbore and fluid needs to routed to the device around another intervening device in the tubing string.

Therefore, a need exists for a way to switch fluids between annular flow channels within a wellbore. Various aspects of the present invention meet such a need.

SUMMARY OF THE INVENTION

A concentric tubing well completion system and subsurface annular flow crossover are provided. The well completion system creates at least three concentric annular flow channels in a wellbore. One or more subsurface flow crossovers provide for switching fluid flow between the annular flow channels within the completed well. A crossover can be used in conjunction with other subsurface equipment to more efficiently manage fluid flows in the completed well for the purposes of produced fluid extraction and supply of a working fluid to a subsurface device.

In one aspect of the invention, three or more concentric tubing strings create a concentric tubing string with independent annular flow channels from an underground fluid reservoir to ground level or above ground level. A separate device or flow loop is installed at the lower end of the concentric tubing string to create a pressure isolated, continuous, flow loop from the surface end to the underground end of the concentric tubing string. The system uses a flow crossover that allows the fluid in any annulus to be redirected into any of the other annuli while maintaining the pressure and chemical integrity of the fluid.

In another aspect of the invention, the flow crossover can be mounted at any point in the tubing string. In addition, multiple flow crossovers can be installed downhole to allow movement of the fluid from one annulus to another as desired.

In another aspect of the invention, the system uses threaded joints with sliding seals at the lower end of the interior tubing strings to allow installation and extraction of the underground equipment with surface lifting equipment alone. No subsurface grappling or latching equipment is required.

In another aspect of the invention, the system can be assembled into different sections in which the fluid flowing in one annulus may be switched to flow into a different annulus. This can allow changing the flow path of hot and cold fluid streams. The system can be used to recover heat from a fluid stream, control solids precipitation by maintaining fluid temperature, use a heated circulating fluid to lower the fluid viscosity of a produced fluid.

This brief summary has been provided so that the nature of the invention may be understood quickly. A more complete understanding of the invention can be obtained by reference to the following detailed description in connection with the attached drawings.

BRIEF DESCRIPTION OF THE DRAWINGS

The invention will be more readily understood from a detailed description of the exemplary embodiments taken in conjunction with the following figures.

DETAILED DESCRIPTION OF THE INVENTION

Figure 1:
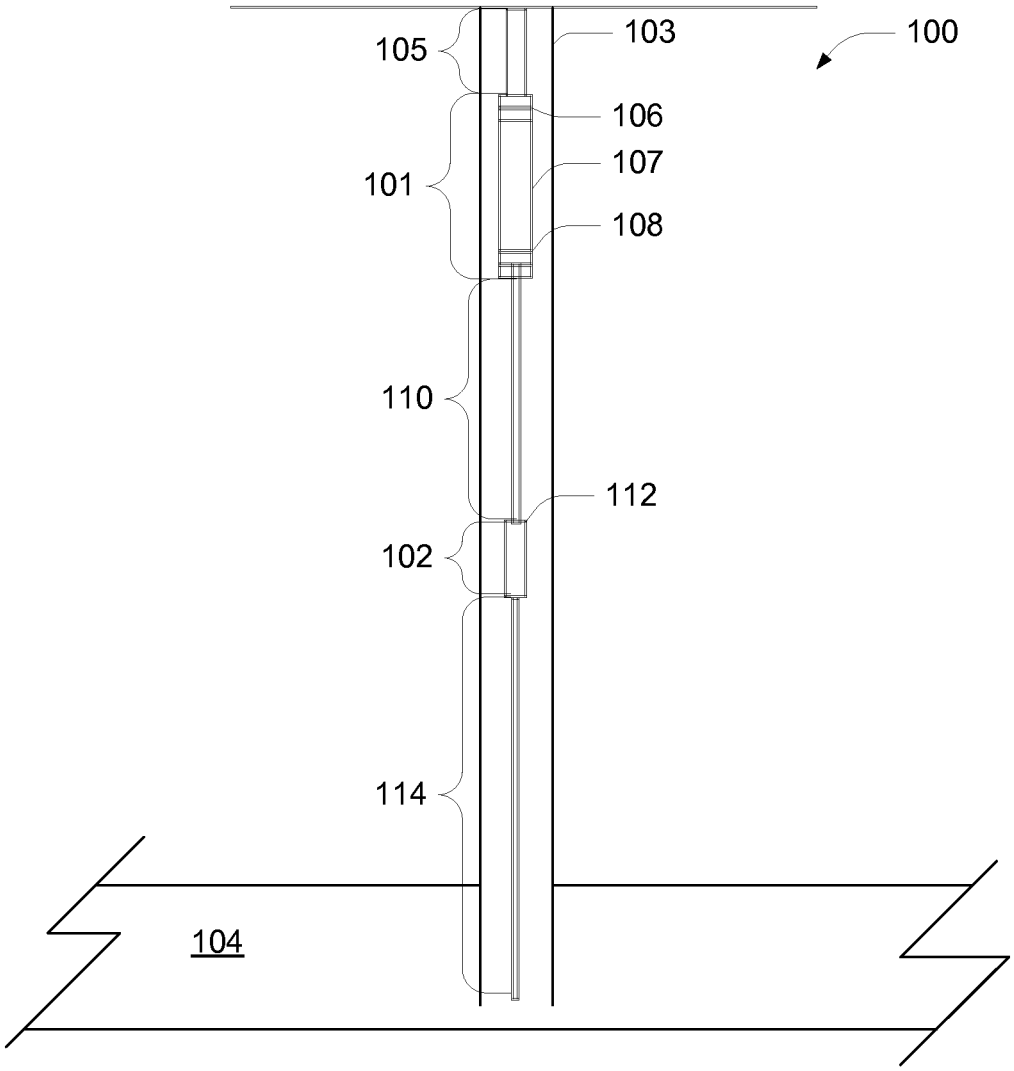
FIG. 1 is a schematic diagram of a well completion system for a wellbore in accordance with an exemplary embodiment of the invention.

FIG. 1 is a schematic diagram of a well completion system in accordance with an exemplary embodiment of the invention. The well completion system 100 includes two subsurface sections, a heat exchanger section 101 and a fluidically powered pumping section 102, that extend into a well bore 103. As depicted in the diagram, the wellbore is intended for production of geothermally heated brine from a subsurface production zone 104; however, it is to be understood that the well completion system is not limited to only geothermal applications.

The well completion system 100 uses concentric tubing strings having three concentric pipes or tubing strings to create independent flow paths from the production zone 104 to the surface. A separate device or flow loop can be installed at the lower end of the concentric tubing strings to create a pressure isolated, continuous, flow loop from the surface to the underground end of the concentric tubing strings. The well completion system 100 uses annular flow crossovers that allow a fluid in any annular flow channel of the concentric tubing strings to be redirected into any other annular flow channel while maintaining the pressure and chemical integrity of the fluid. The annular flow crossovers can be mounted at any point in the concentric tubing strings. Multiple annular flow crossovers can be installed downhole to allow movement of the fluid from one annular flow channel to another as desired.

The well completion system 100 uses threaded joints with sliding seals at the lower end of the interior tubing strings of the concentric tubing strings to allow installation and extraction of the underground equipment with surface lifting equipment alone. No subsurface grappling or latching equipment is required. The well completion system 100 can be assembled into different sections in which the fluid flowing in one annular flow channel may be switched to flow into a different annular flow channel. This can allow changing the flow path of hot and cold fluid streams. The well completion system 100 can be used to recover heat from a fluid stream, control solids precipitation by maintaining fluid temperature, use a heated circulating fluid to lower the fluid viscosity of a produced fluid, etc.

The entire underground assembly consists of sections of concentric tubing strings. A annular flow crossover is installed at the top and bottom of each intermediate section to redirect the fluid flowing in one annular flow channel into a different annular flow channel, if desired. Each separate section is run by assembling joints of the outside tubing string with threaded connections at each end. The bottom section of the outside tubing string of a concentric tubing string supports any type of downhole device installed at the lower end of the tubing string. The device incorporates polished receptacles at the top of the device. These receptacles are capable of accepting a seal assembly installed at the lower end of each interior tubing string. The interior tubing string strings are installed after the outside tubing string is assembled and suspended in the hole. The concentric tubing string strings are installed sequentially from the outer string toward the center string. The lower end of each interior tubing string with the seal installed at the end are assembled and additional sections added until the seal enters the receptacle at the bottom of the adjacent outer string.

The tubing string being run is suspended by a hanger assembly mounted on the inside of the outer tubing string. The top of each tubing string has a seal receptacle installed. This allows the installation of the annular flow crossover assembly with its seals to isolate each flow path. Subsequent sections can vary in design. Some possible design configurations include single or multiple heat exchanger sections, intermediate concentric tubing string sections, flow limiting sections, and pumping devices. These sections can be interspersed and placed at any intermediate depth in the well.

The well completion system 100 includes a heat exchanger section 101 connected to an upper concentric tubing string section 105 that has a plurality of annular flow channels. The upper concentric tubing string section 105 is mechanically connected at a lower end to an upper annular flow crossover 106. The upper annular flow crossover provides both mechanical and fluidic connectivity between the annular flow channels of the upper concentric tubing string section 105 and a heat exchanger 107. The heat exchanger is connected at a lower end to a lower annular flow crossover 108. The lower annular flow crossover 108 mechanically and fluidically connects the heat exchanger 107 to a lower concentric tubing string section 110 that is connected to fluidically powered pumping section 102. The lower concentric tubing string section 110 provides mechanical and fluidic connectivity between the lower flow crossover 108 and a fluidically driven pump 112. The fluidically driven pump 112 is optionally mechanically and fluidically connected to a tail pipe 114 that extends into the production zone 104.

The well completion system 100 and the concentric tubing strings can accommodate a working fluid that both drives the fluidically driven pump 112 and extracts heat from heated brine produced from the production zone 104. To do so, downwardly flowing working fluid flows through a respective annular flow channel of the concentric tubing strings 105 and 110. Returning upwardly flowing working fluid flows to the surface through another respective annular flow channel of the concentric tubing strings 105 and 110. In addition, heated brine produced from the production zone 104 flows through yet another annular flow channel of the concentric tubing strings 105 and 110.

In operation, the downwardly flowing working fluid is pumped into the upper concentric tubing string section 105 down through the upper annular flow crossover 106 which routes the downwardly flowing working fluid into the heat exchanger 107. The downwardly flowing working fluid then flows out of the heat exchanger 107 and into the lower annular flow crossover 108 which routes the downwardly flowing working fluid to the fluidically driven pump 112. The fluidically driven pump 112 is driven by the downwardly flowing working fluid which draws heated brine from the production zone 104. The heated brine is pumped toward the surface along with the returning upwardly flowing working fluid. The heated brine and upwardly flowing working fluid travel up through the lower concentric tubing string section 110 in their separate respective concentric flow channels to the lower annular flow crossover 108. The lower annular flow crossover routes the heated brine into the heat exchanger and the upwardly flowing working fluid through the heat exchanger 107. In the heat exchanger, heat is extracted from the heated brine into the working fluid.

After leaving the heat exchanger, the heated brine and upwardly flowing working fluid are produced from the well at the surface. Once at the surface, the heated working fluid is used to power a turbine that in turn drives an electrical generator. The working fluid is then circulated back into the well completion system 100. Residual heat in the brine may also be extracted and used to power a turbine before the brine is injected back into the production zone.

As described herein, the well completion system 100 maintains a separated flow channel from the production zone to the surface for brine produced from the production zone. It is to be understood that the well completion system can be used to move brine between different production and injection zones, from more than one production zone, into more than one injection zone etc. as the well completion system 100 can accommodate additional intermediate openings into the tubing strings or well casing.

In other embodiments of the well completion system 100, the tail pipe 114 is dispensed with and an alternative completion method is used at the bottom of the wellbore. The alternative completion method can include an open hole completion, another concentric tubing string, etc.

Figure 2A:
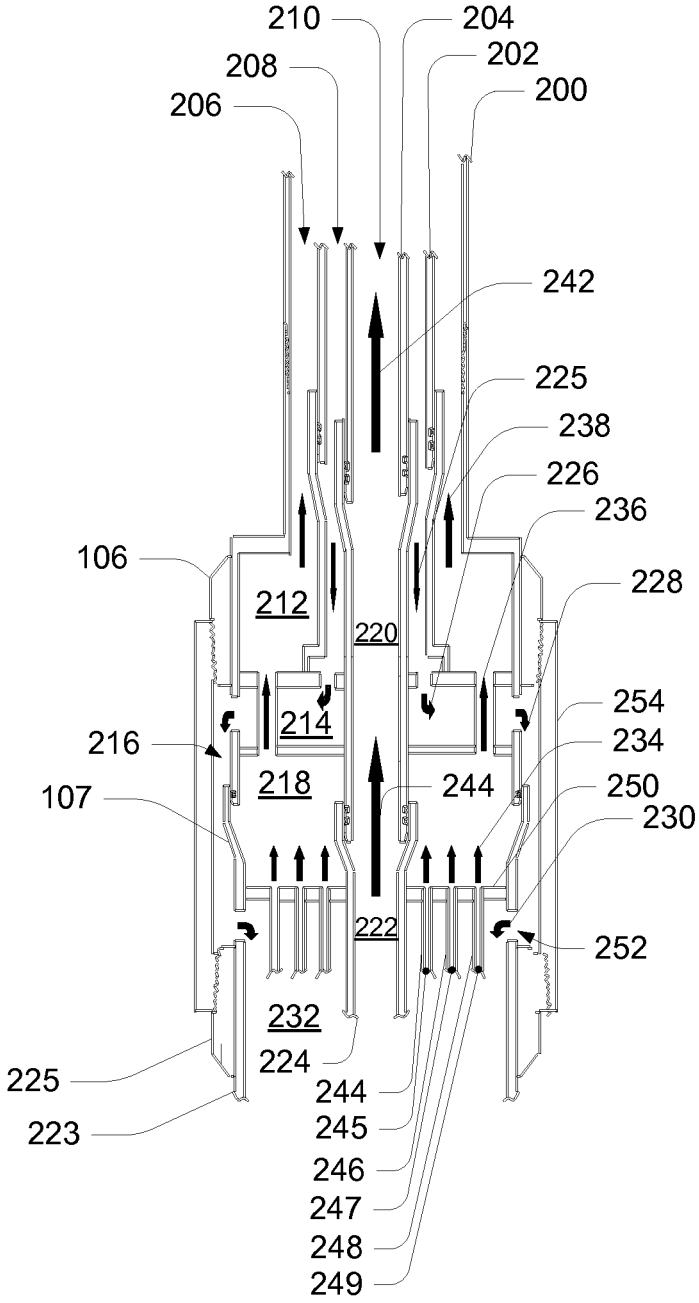
FIG. 2*a* is a cross-sectional drawing of an upper annular flow crossover and an upper portion of a subsurface heat exchanger in accordance with an exemplary embodiment of the invention.

Having provided an overview of the well completion system in accordance with an exemplary embodiment of the invention, individual components of the well completion system will now be described in greater detail with reference to FIGS. 2*a*, 2*b*, 2*c*, 3 and 4 where like numbered elements refer to the same features illustrated in the figures. FIG. 2*a* is a cross-sectional drawing of an upper annular flow crossover in accordance with an exemplary embodiment of the invention. The upper annular flow crossover 106 mechanically and fluidically connects the upper concentric tubing string section 105 to the subsurface heat exchanger 107. The concentric tubing string 105 has an outermost tubing string 200 and one or more concentric successive tubing strings, such as tubing strings 202 and 204. Each successive tubing string defines an annular flow channel between an inner surface of a preceding tubing string and an outer surface of the successive tubing string. For example, tubing strings 200 and 202 define one annular flow channel 206 therebetween and tubing strings 202 and 204 define another annular flow channel 208 therebetween. In addition, an innermost annular flow channel 210 is defined by an interior surface of the innermost tubing string 204. Therefore, a number of successive annular flow channels are defined that succeed from an outermost tubing string flow channel 206 to an innermost tubing string flow channel 210.

The upper annular flow crossover 106 has one or more flow channels, such as flow channels 212 and 214, fluidically connecting a tubing string flow channel of the upper concentric tubing string section 105 to a non-corresponding flow channel in the heat exchanger 107. For example, flow channel 214 connects annular flow channel 208 to a relatively outer non-corresponding flow channel 216 of the heat exchanger 107. In addition, flow channel 212 connects annular flow channel 206 to a relatively inner non-corresponding flow channel 218 of heat exchanger 107.

In addition, the annular flow crossover 106 may have one or more flow channels that fluidically couple a corresponding flow channel of the upper tubing string 105 to the heat exchanger 107. For example, flow channel 210 of the concentric tubing string 105 is connected to central flow channel 222 of the heat exchanger 107 via flow channel 220 of the upper annular flow crossover 106.

In one embodiment of an annular flow crossover in accordance with the invention, the annular flow crossover 106 is threadably connected to the outermost tubing string 200 and to an outer tube 223 of the heat exchanger 107. In addition, the annular flow crossover 106 is slidably and rotably coupled to the successive tubing strings, such as tubing strings 202 and 204, of the upper concentric tubing string section 105 and an inner tube 224 of the heat exchanger 107.

The heat exchanger 107 is constructed of an inner tube 224 within an outer tube 223. The annular flow channel 232 between the inner tube 224 and the outer tube 223 has one or more heat exchange tubes, such as heat exchange tubes 244, 246 and 248, passing therethrough. The heat exchange tubes define one or more isolated internal flow channels, such as internal flow channels 245, 247 and 249, through the heat exchanger. The heat exchange tubes are installed and sealed at an upper plate 250 and a lower plate (not shown) located at a respective each end of the inner tube 224 and the outer tube 223, thus creating a shell and tube exchanger. A fluid stream flowing through the heat exchange tubes is isolated from a fluid flowing in the annular flow channel 232. A shell side of the heat exchanger 107 is thus defined as the flow channel 232 between the inner tube 224 and the outer tube 223 and external to the heat exchange tubes.

Fluid that flows through the shell side of the heat exchanger 107 flows into one or more ports, such as port 252, cut in a side of the outer tube 223 and through the annular flow channel 216 between an outside surface of the outer tube 223 and a concentric threaded collar 254 that threadably connects the upper annular flow crossover 106 to the heat exchanger 107 via a sealing collar 255 on an exterior surface of the outer tube 223. The concentric threaded collar 254 provides both a structural connection and a pressure tight seal between the upper annular flow crossover 106 and the heat exchanger 107.

In operation, the upper annular flow crossover 106 receives downwardly flowing working fluid (as indicated by flow arrows 225, 226, 228 and 230) from annular flow channel 208 and routes the downwardly flowing working fluid to flow channel 216 of the heat exchanger 107 via flow channel 214. The downwardly flowing working fluid then flows into flow chamber 232 of heat exchanger 107.

In addition, the upper annular flow crossover 106 receives upwardly flowing heated brine (as indicated by flow arrows 234, 236 and 238) from the heat exchanger 107 and routes the upwardly flowing heated brine from flow channel 218 of the heat exchanger to flow channel 206 of the upper concentric tubing string section 105. While in the heat exchanger 107, heat is transferred from the heated brine to the downwardly flowing working fluid.

The upper annular flow crossover 106 also receives upwardly flowing heated working fluid (as indicated by flow arrows 240 and 242) from the heat exchanger 107. The upper annular flow crossover 106 routes the upwardly flowing heated working fluid into the innermost flow channel 210 of the concentric tubing string 105 from flow channel 222 of the heat exchanger 107 by flow channel 220 of the upper annular flow crossover 106.

Figure 2B:
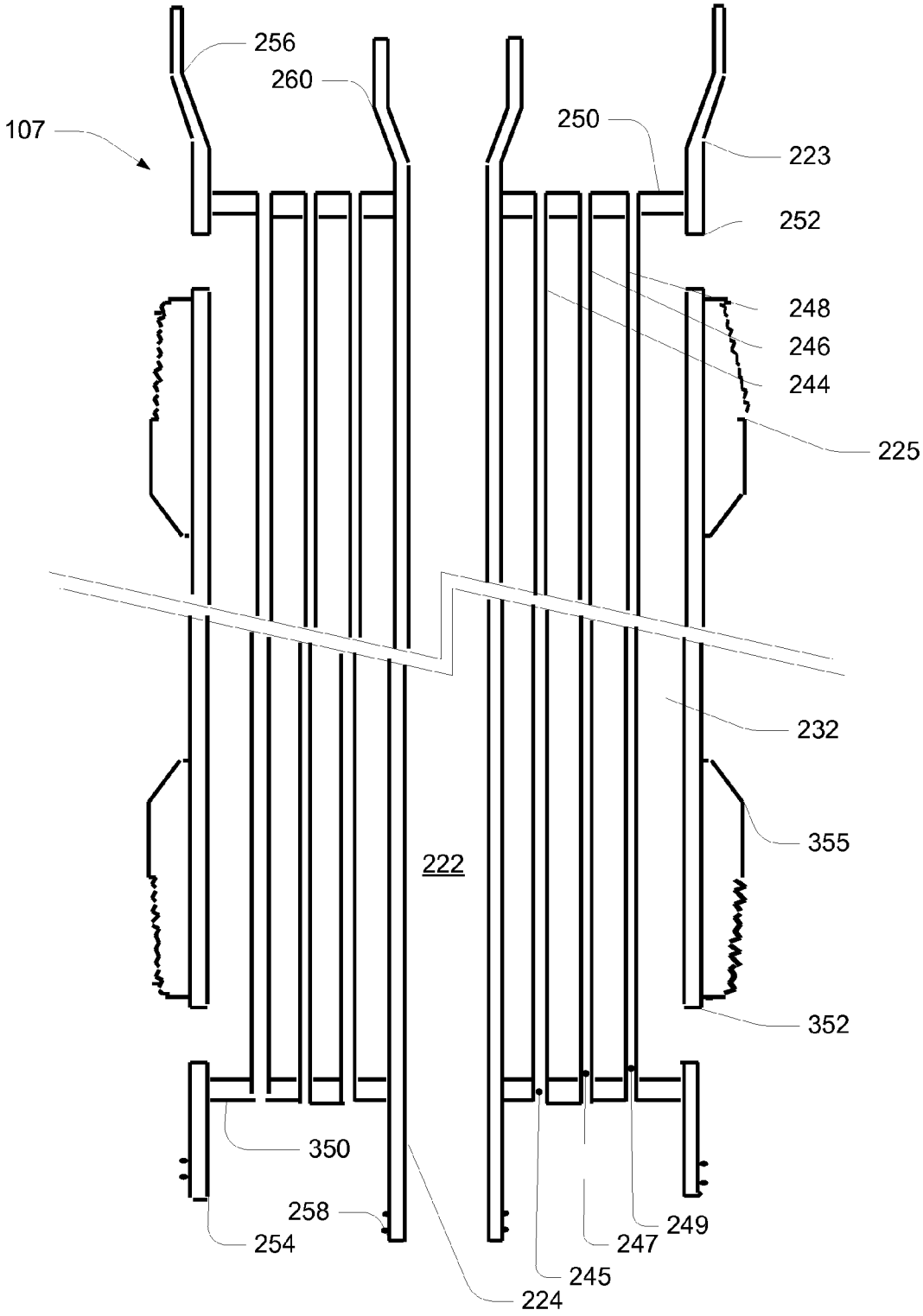
FIG. 2*b* is a cross-sectional drawing of a heat exchanger section in accordance with an exemplary embodiment of the invention.

FIG. 2*b* is a cross-sectional diagram of a heat exchanger in accordance with an exemplary embodiment of the invention. As previously described, the heat exchanger 107 is constructed of an inner tube 224 within an outer tube 223. An inner surface of the inner tube 224 defines a central flow channel 222. An annular flow channel 232 is defined between an outer surface of the inner tube 224 and the inner surface of outer tube 223. The annular flow channel 232 has one or more heat exchange tubes, such as heat exchange tubes 244, 246 and 248, passing therethrough. The heat exchange tubes define one or more isolated internal flow channels, such as internal flow channels 245, 247 and 249, through the heat exchanger 107. The heat exchange tubes are installed and sealed at an upper plate 250 and a lower plate 350 located at a respective each end of the inner tube 224 and the outer tube 223, thus creating a shell and tube exchanger. Fluid that flows through the annular flow channel 232 of the heat exchanger 107 flows through one or more ports, such as ports 252 and 352, cut in a side of the outer tube 223.

The outer tube 223 has a sealing assembly 254 and a receptacle 256 for receiving a sealing assembly located at respective ends of the outer tube 223. The inner tube 224 is similarly constructed as inner tube 224 also has a sealing assembly 258 and a receptacle 260 for receiving a sealing assembly located at respective ends.

Respective upper and lower sealing collars 255 and 355 are located on an exterior surface of the outer tube 223. The sealing collars 255 and 355 are used to threadably connect the heat exchanger 107 to a tubing string or an annular flow crossover using a concentric threaded collar as previously described. The sealing collars may be separate components that are connected to the exterior surface of the outer tube 223 or may be part of a machined assembly that incorporates the other features of an end portion of outer tube 223, such as sealing assembly 254, receptacle 256, port 352, port 252, etc. as may be desired.

Figure 2C:
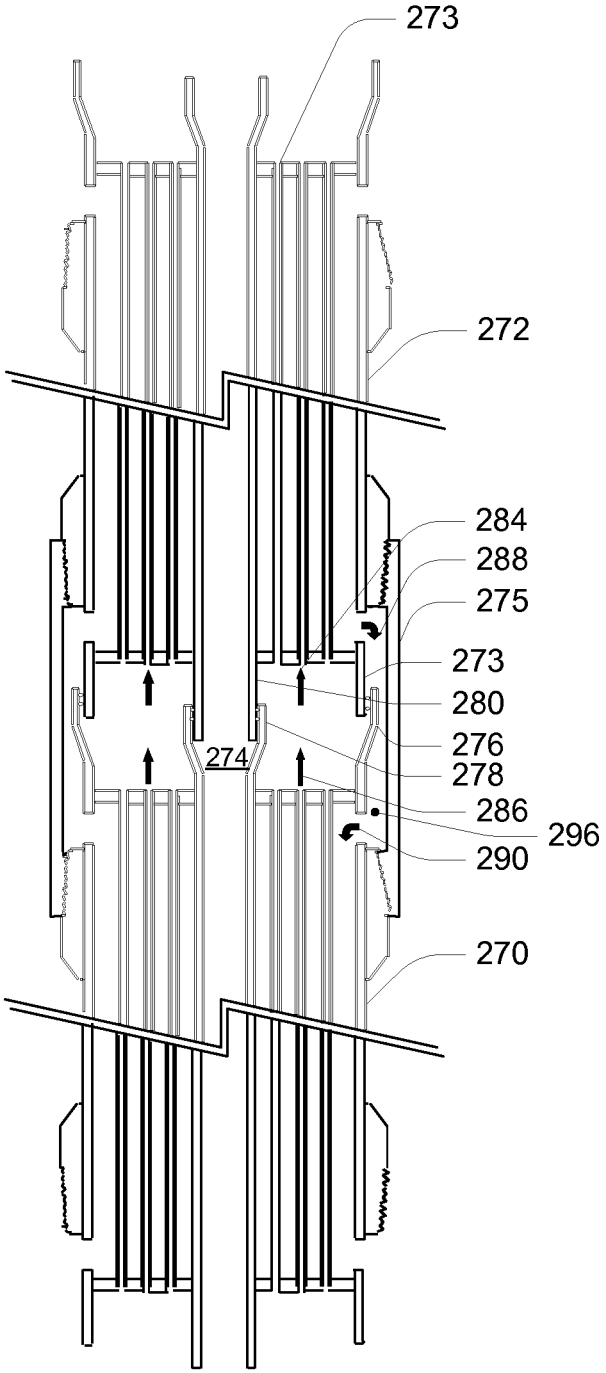
FIG. 2*c* is a cross-sectional drawings of two heat exchanger sections joined together in accordance with an exemplary embodiment of the invention.

FIG. 2*c* is a cross-sectional drawings of two heat exchangers joined together in accordance with an exemplary embodiment of the invention. In one embodiment of a subsurface heat exchanger in accordance with the invention, any number of heat exchangers, such as heat exchangers 270 and 272, can be assembled sequentially in a wellbore in the same way as normal oil field casing or tubing. The flow paths for the fluid flowing through heat exchanger tubes, such as heat exchanger tube 273, and a central flow channel 274 are isolated using a stab-in type of seal assembly and receptacle, such as seal assembly 280 and receptacle 278 for the central flow channel, and seal assembly 273 and receptacle 276 for the flow flowing through the heat exchanger tubes. Such a seal mechanism provides a seal to prevent any fluid cross flow between the other flow paths.

The heat exchanger sections 270 and 272 are joined together by a threaded concentric collar 275 that mates with a first sealing collar 292 and a second sealing collar 294. The threaded concentric collar forms a flow channel 296 around the mated outer sealing assembly 273 and respective receptacle 276. The flow channel 296 provides a flow channel for fluid flowing through as shell side of the heat exchanger, as indicated by flow arrows 288 and 290.

The heat exchanger sections 270 and 272 can be supplied with or without a concentric coupling collar 275 already assembled to one end of a heat exchanger section. Assembly of the concentric coupling collar 275 and heat exchanger sections 270 and 272 can thus be accomplished at a well site using standard oil field equipment.

As depicted in FIGS. 2*a*, 2*b* and 2*c*, the sealing assemblies and corresponding receptacles are configured such that entry of each sealing assembly into its corresponding receptacle may be confirmed prior to contact of the coupling. In other embodiments of heat exchanger sections, a sealing assembly and its corresponding receptacle may be connected after the threading of a sealing collar with a threaded concentric collar has begun.

Figure 3:
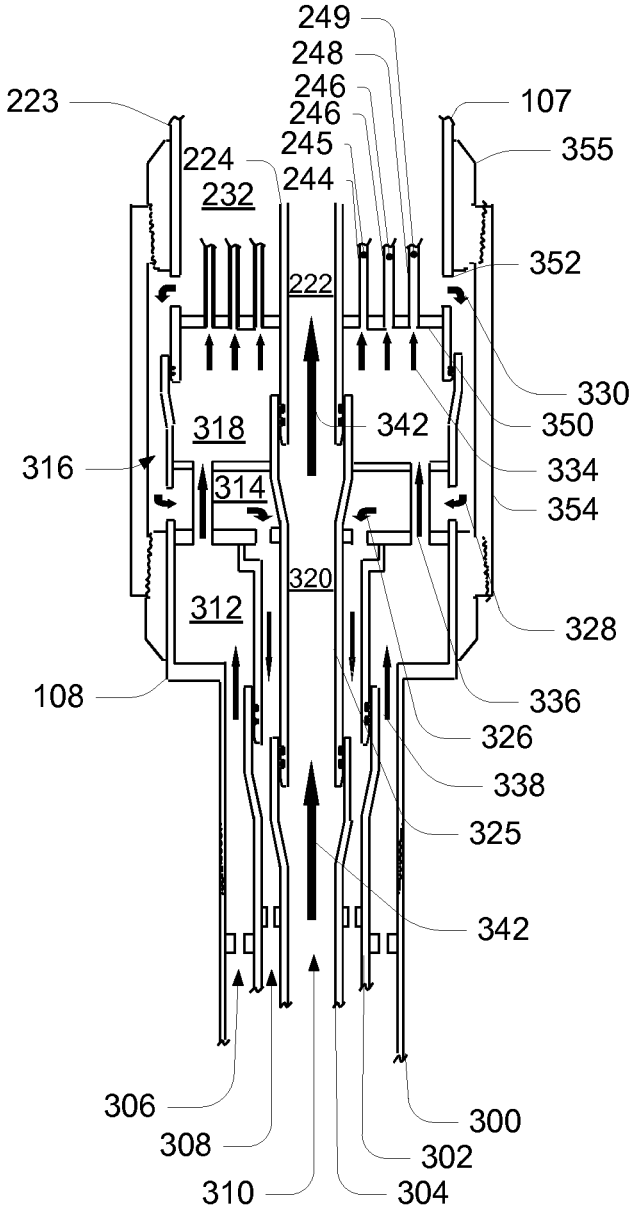
FIG. 3 is a cross-sectional drawing of a lower annular flow crossover and a lower portion of a subsurface heat exchanger in accordance with an exemplary embodiment of the invention.

FIG. 3 is a cross-sectional drawing of a lower annular flow crossover in accordance with an exemplary embodiment of the invention. The lower annular flow crossover 108 mechanically and fluidically connects the lower concentric tubing string section 110 to the subsurface heat exchanger 107. The lower concentric tubing string section 110 has an outermost tubing string 300 and one or more concentric successive tubing strings, such as tubing strings 302 and 304. Each successive tubing string defines an annular flow channel between an inner surface of a preceding tubing string and an outer surface of the successive tubing string. For example, tubing strings 300 and 302 define one annular flow channel 306 therebetween and tubing strings 302 and 304 define another annular flow channel 308 therebetween. In addition, an innermost annular flow channel 310 is defined by an interior surface of the innermost tubing string 304. Therefore, a number of successive annular flow channels are defined that succeed from an outermost tubing string flow channel 306 to an innermost tubing string flow channel 310.

The lower annular flow crossover 108 has one or more flow channels, such as flow channels 312 and 314, fluidically connecting a tubing string flow channel of the lower concentric tubing string section 110 to a non-corresponding flow channel in the heat exchanger 107. For example, flow channel 312 connects annular flow channel 306 to a relatively inner non-corresponding flow channel 318 of the heat exchanger 107. In addition, flow channel 314 connects annular flow channel 308 to a relatively outer non-corresponding flow channel 316 of heat exchanger 107.

In addition, the lower annular flow crossover 108 may have one or more flow channels that fluidically couple a corresponding flow channel of the lower tubing string 110 to the heat exchanger 107. For example, flow channel 310 of the lower concentric tubing string section 110 is connected to central flow channel 222 of the heat exchanger 107 via flow channel 320 of the lower annular flow crossover 108.

In one embodiment of a lower annular flow crossover in accordance with the invention, the lower annular flow crossover 108 is threadably connected to the outermost tubing string 300 and to an outer tube 223 of the heat exchanger 107. In addition, the annular flow crossover 108 is slidably and rotably coupled to the successive tubing strings, such as tubing strings 302 and 304, of the lower concentric tubing string section 110 and an inner tube 224 of the heat exchanger 107.

As previously described, the heat exchanger 107 consists of an inner tube 224 within an outer tube 223. The annular flow channel 232 between the inner tube 224 and the outer tube 223 has one or more heat exchange tubes, such as heat exchange tubes 244, 246 and 248, passing therethrough. The heat exchange tubes are installed and sealed at an upper plate (not shown) and a lower plate 350 located at a respective each end of the inner tube 224 and the outer tube 223, thus creating a shell and tube exchanger. A fluid stream flowing through the heat exchange tubes is isolated from a fluid flowing in the annular flow channel 232. A shell side of the heat exchanger 107 is thus defined as the flow channel 232 between the inner tube 224 and the outer tube 223 and external to the heat exchange tubes.

Fluid that flows through the shell side of the heat exchanger 107 flows through one or more ports, such as port 352, cut in a side of the outer tube 223 and through the annular flow channel 316 between an outside surface of the outer tube 223 and a concentric threaded collar 354 that threadably connects the lower annular flow crossover 108 to the heat exchanger 107 via a sealing collar 355 on an exterior surface of the outer tube 223. The concentric threaded collar 354 provides both a structural connection and a pressure tight seal between the lower annular flow crossover 108 and the heat exchanger 107.

In operation, the lower annular flow crossover 108 receives upwardly flowing heated brine (as indicated by flow arrows 334, 336 and 338) from flow channel 306 of the lower concentric tubing string section 110 and routes the heated brine via flow channel 312 into flow channel 318 of the heat exchanger 107. While in the heat exchanger, heat is transferred from the heated brine to the downwardly flowing working fluid.

In addition, the lower annular flow crossover 108 receives downwardly flowing working fluid (as indicated by flow arrows 325, 326, 328 and 330) from flow channel 316 of heat exchanger 107 and routes the downwardly flowing working fluid to flow channel 308 of the lower concentric tubing string section 110 via flow channel 314.

The lower annular flow crossover 108 also receives upwardly flowing heated working fluid (as indicated by flow arrows 340 and 342) from the lower concentric tubing string section 110. The lower annular flow crossover 108 routes the upwardly flowing heated working fluid from the innermost flow channel 310 of the lower concentric tubing string section 110 to flow channel 222 of the heat exchanger 107 by flow channel 320 of the lower annular flow crossover 106.

Figure 4:
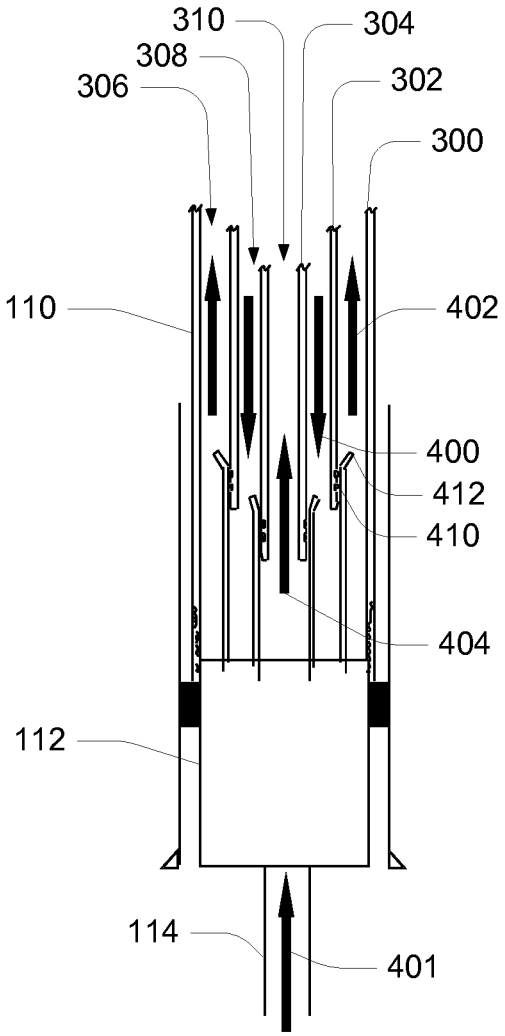
FIG. 4 is a cross-sectional drawing of a subsurface fluidically driven pump in accordance with an exemplary embodiment of the invention.

FIG. 4 is a cross-sectional drawing of a subsurface fluidically driven pump in accordance with an exemplary embodiment of the invention. The fluidically driven pump 112 is mechanically and fluidically connected to the lower concentric tubing string section 110. As previously described, the lower concentric tubing string section 110 has an outermost tubing string 300 and one or more concentric successive tubing strings, such as tubing strings 302 and 304. Each successive tubing string defines an annular flow channel between an inner surface of a preceding tubing string and an outer surface of the successive tubing string. For example, tubing strings 300 and 302 define one annular flow channel 306 therebetween and tubing strings 302 and 304 define another annular flow channel 308 therebetween. In addition, an innermost annular flow channel 310 is defined by an interior surface of the innermost tubing string 304. Therefore, a number of successive annular flow channels are defined that succeed from an outermost tubing string flow channel 306 to an innermost tubing string flow channel 310. A seal assembly, such as seal assembly 410, is mounted at the lower end each concentric tubing string. Each seal assembly on each concentric tubing string is slipped into a seal receptacle, such as seal receptacle 412.

The fluidically driven pump 112 is further coupled to an tail pipe 114 that has a lower opening (not shown) in communication with a reservoir of hot brine. In operation, downwardly flowing working fluid (as indicated by flow arrow 400) flows into the fluidically driven pump 112 from the annular flow channel 308 of the lower concentric tubing string section 110. The fluidically driven pump 114 is then driven by the working fluid and takes in heated brine (as indicated by flow arrow 401) from tail pipe 114 and pumps the heated brine (as indicated by flow arrow 402) upwardly through the annular flow channel 306 of the lower concentric tubing string section 110. After driving the fluidically driven pump 112, the working fluid flows (as indicated by flow arrow 404) upwardly through flow channel 310 of the lower concentric tubing string section 110.

In the foregoing description, the outermost annular flow channel in the concentric tubing strings 105 and 110 is depicted as containing heated brine, the next successive annular flow channel is depicting as containing downwardly flowing working fluid and the innermost flow channel is depicted as containing heated working fluid. However, in various other embodiments of the invention, the order and assignment of flow channels can be altered in accordance with the needs of the fluids being conveyed as the order and assignment is arbitrary. Furthermore, the order and assignment of the flow channels may be altered such that the different sections of concentric tubing strings have a different order and assignment. In addition, in the foregoing description only three flow channels are depicted. In other embodiments of the invention, fewer or more flow channels may be provided without deviating from the spirit of the invention.

Having described the individual components of a well completion system in accordance with an exemplary embodiment of the invention, the assembly procedure for such a well completion system will now be described in reference to FIGS. 5*a* to 5*i* where like numbered elements refer to the same features illustrated in the figures. FIGS. 5*a* to 5*i* are schematic drawings of an assembly sequence for a well completion system in accordance with an exemplary embodiment of the invention. A fluidically driven downhole pump 500 is a combination fluidically-driven power turbine and pump. The power turbine rotates the pump at sufficient speed to generate a fluid pumping action. The turbine and pump are adjacent to each other and mounted as a common assembly. The power turbine is powered by a working fluid (not shown) descending from the surface as previously described.

A concentric tubing string provides a circulation loop for the working fluid to return to the surface as previously described. To build the concentric tubing string, the fluidically driven pump 500 is installed on a lower end of an outer tubing string 506 and lowered into a well 508 as with conventional oil field casing and tubing. The outer tubing string 506 with the fluidically driven pump 500 connected to the lower end of the outer tubing string 506 is suspended at the drilling rig floor using conventional casing slips. After reaching a selected depth, a false rotary is installed at a drilling rig floor. This allows the weight of subsequent smaller, inside tubing strings 512 and 514 to be transferred to the rig floor during running of the inside tubing strings 512 and 514. The false rotary supports a smaller set of slips and to support the inside tubing strings 512 and 514 as they are run into the larger outside tubing string 506.

Modified pipe hangers 522 are installed at the top of the outer tubing string 506 to allow suspension of the inside tubing string 512 in the outer tubing string. This same type of arrangement is used to run and suspend all subsequent tubing strings as the pipe size decreases. For example, tubing string 512 has pipe hangers 523 mounted on inner surface of tubing string 512 from which tubing string 514 is suspended.

A set of seal receptacles are installed at the top of the fluidically driven pump 500 and the inside tubing strings 512 and 514 each have a seal assembly mounted at the lower end of the concentric tubing string as previously described. Each seal assembly on each tubing string is slipped into a respective seal receptacle at the top of the fluidically driven pump 500. This provides a pressure tight isolation of each of the inside tubing strings 512 and 514. The seal assemblies allow movement of each seal within the seal's respective receptacle to compensate for pipe movement because of wellbore temperature changes. The inside tubing strings 512 to 514 are run in sequence from the largest to the smallest. Each inside tubing string is run, stabbed into the seal receptacle at the bottom of the tubing string and suspended by a hanger, such as hanger 522, at the top of the next larger tubing string.

The well completion system allows intermediate equipment to be installed in a tubing string with concentric tubing strings and allows pressure isolation between the concentric tubing strings, if desired. The same system for running, sealing and hanging can be used at multiple depths in the well.

An optional tail pipe 532 is installed below the fluidically driven pump 500 to allow the installation of many different types of devices. Some of the possible devices are screens for filtration of the borehole fluid, slotted pipe to help guide the assembly into the hole and prevent the intrusion of wellbore debris and seal assemblies to isolate fluid flow from lower in the wellbore, mounting of packer assemblies to allow wellbore zonal isolation, centering devices, vibration damping devices, and the like.

Having presented an overview of the well completion system installation process, the order of installation of the well completion system components will now be presented in reference to FIGS. 5*a* to 5*i* in sequence.

Figure 5A:
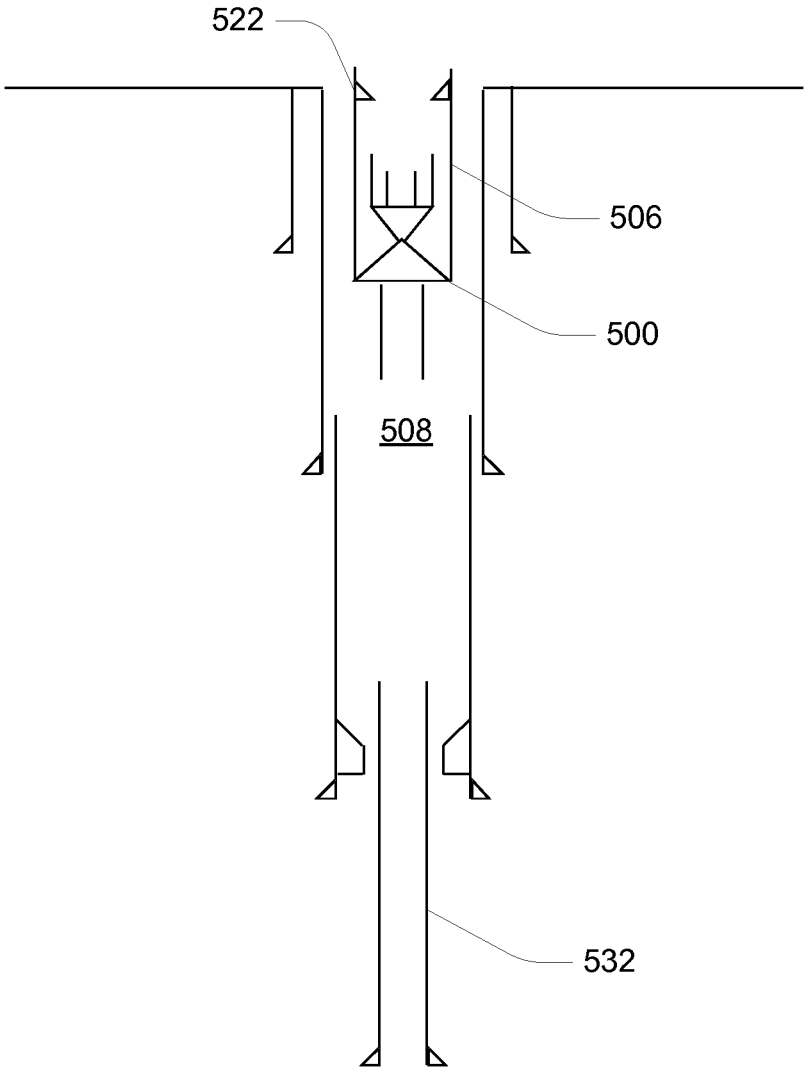
FIGS. 5*a* to 5*i* are schematic drawings of an assembly sequence for a well completion system in accordance with an exemplary embodiment of the invention.
Figure 5B:
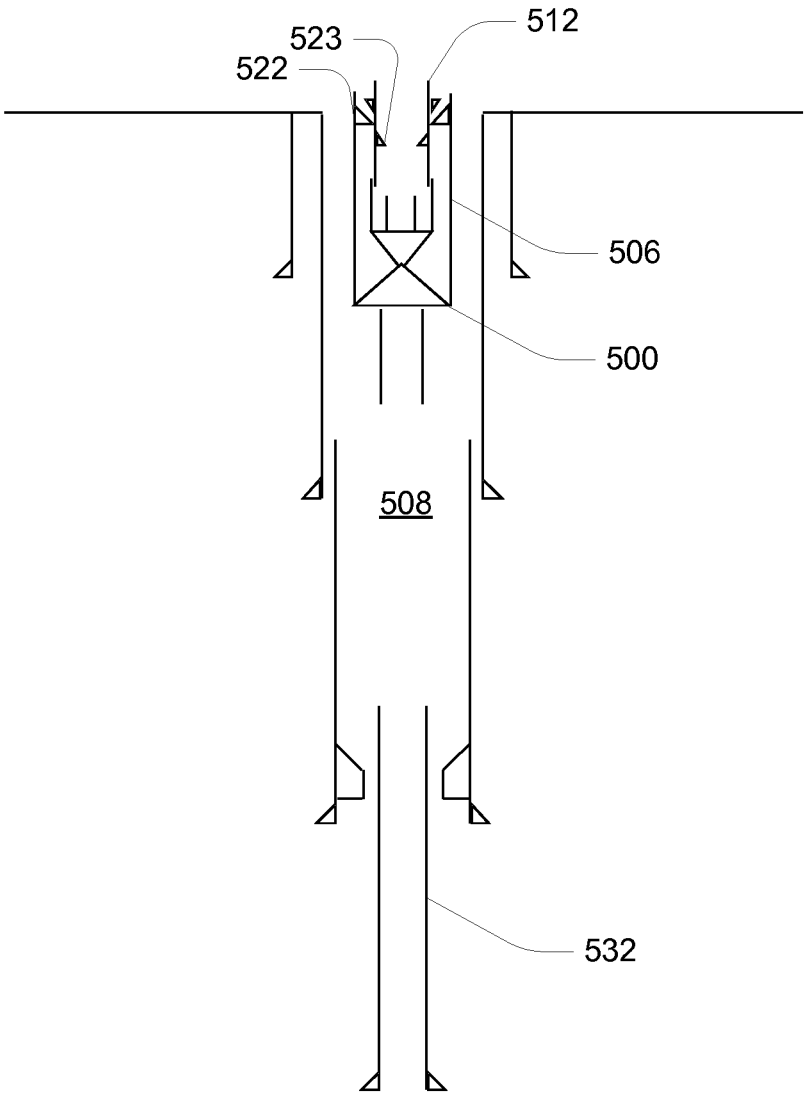
Figure 5C:
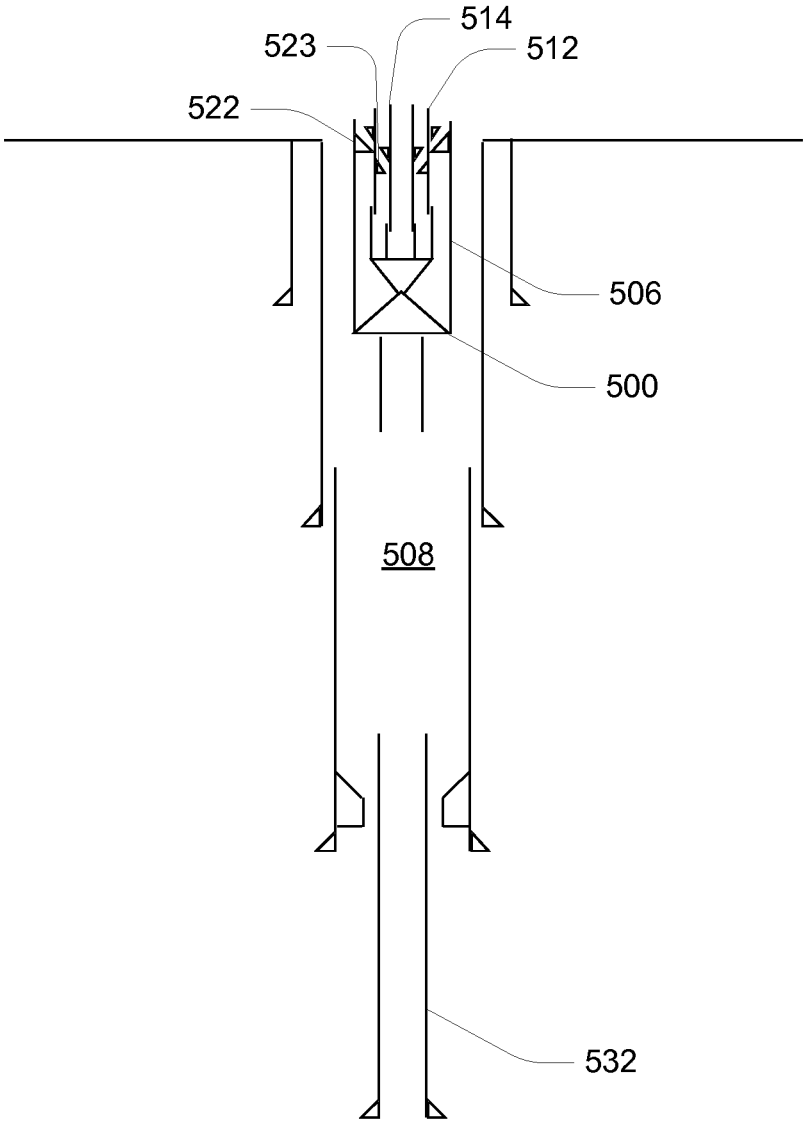

As depicted in FIG. 5*a*, the fluidically driven pump 500 is lowered into well 508. The fluidically driver pump 500 is connected to a lower end of outer tubing string 506. In FIG. 5*b*, inner tubing string 512 is inserted into outer tubing string 506. The lower end of inner tubing string 512 has a sealing assembly that is inserted into a sealing receptacle of fluidically driven pump 500. In FIG. 5*c*, inner tubing string 514 is inserted into inner tubing string 512 and is sealably connected to fluidically driven pump 500 by a respective sealing assembly and sealing receptacle.

Figure 5D:
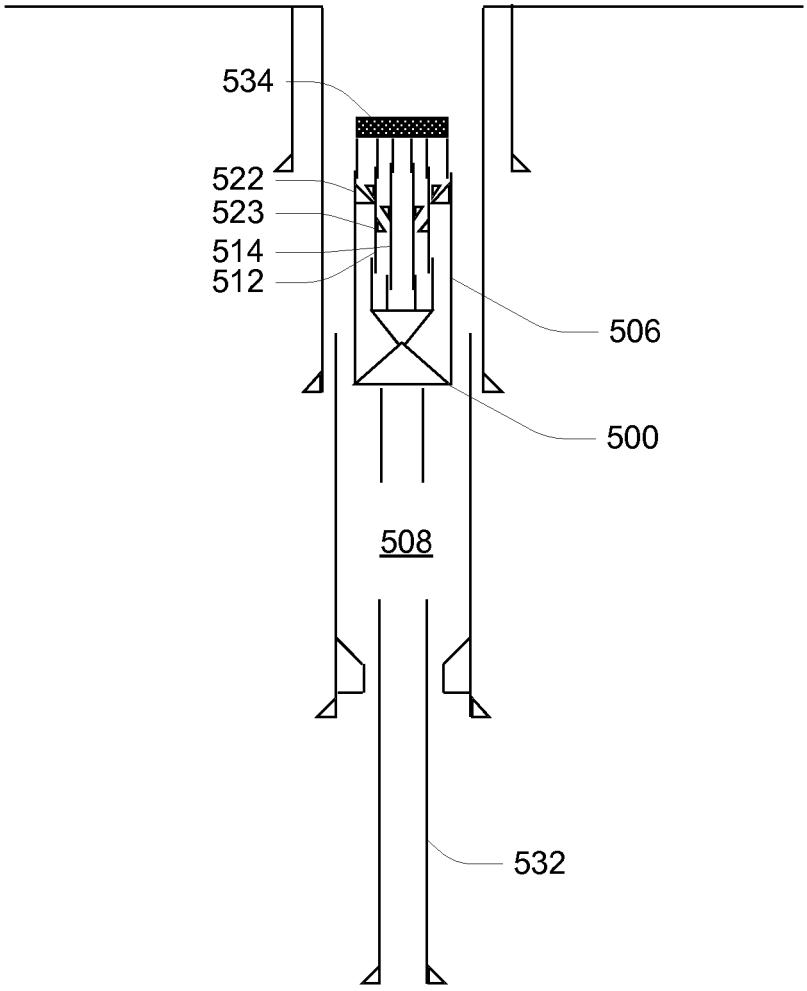
Figure 5E:
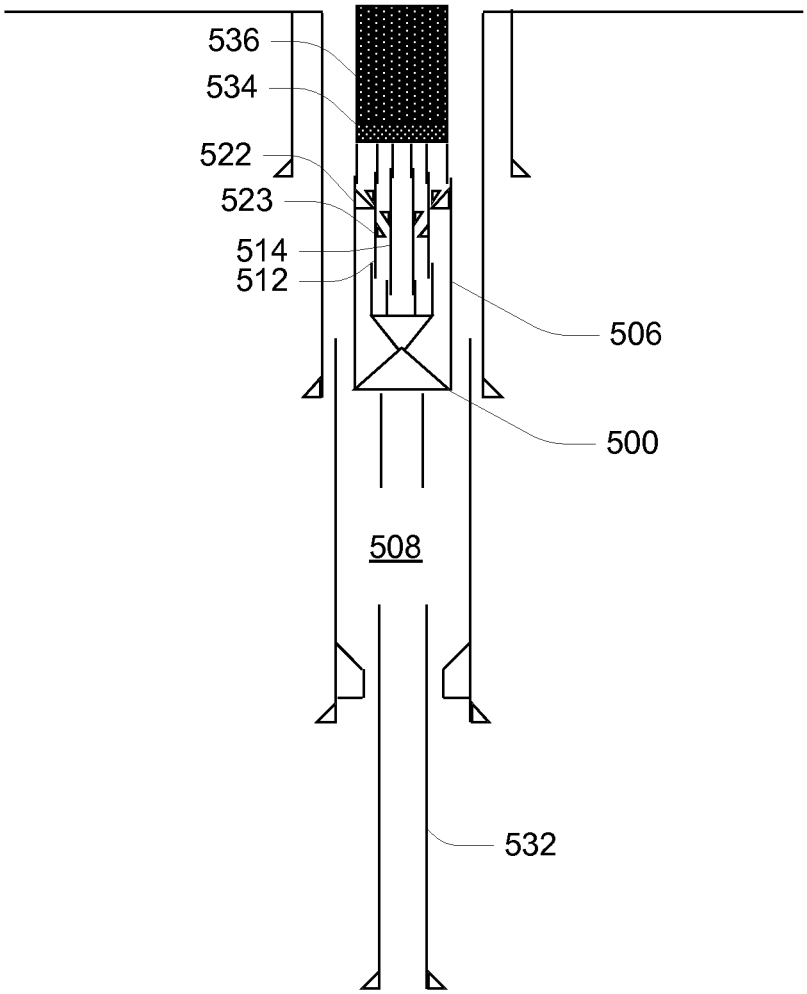

In FIG. 5*d*, a lower annular flow crossover 534 as described in FIG. 3 is attached to an upper end of the concentric tubing string created from tubing strings 506, 512 and 514. In FIG.

Figure 5F:
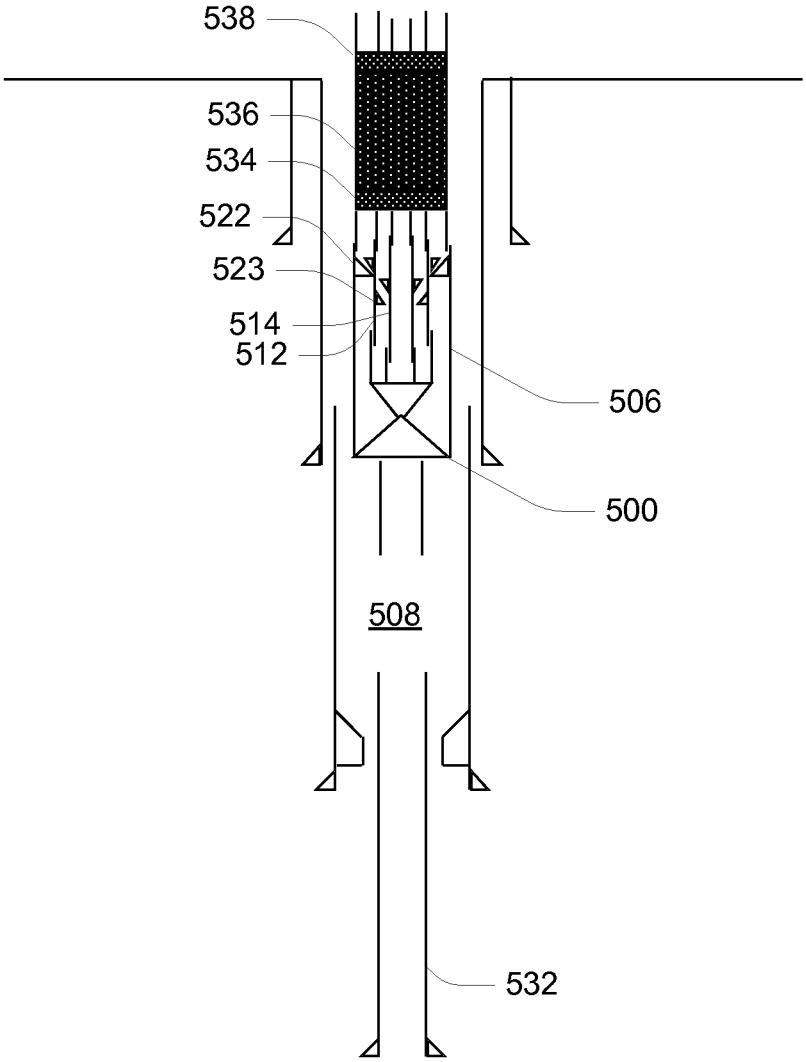

5*e*, one or more heat exchanger sections 536 (as described in FIG. 2 and FIG. 3) are installed to the lower annular flow crossover 534. In FIG. 5*f*, an upper annular flow crossover 538 (as described in FIG. 2) is installed on an upper end of heat exchanger 536.

Figure 5G:
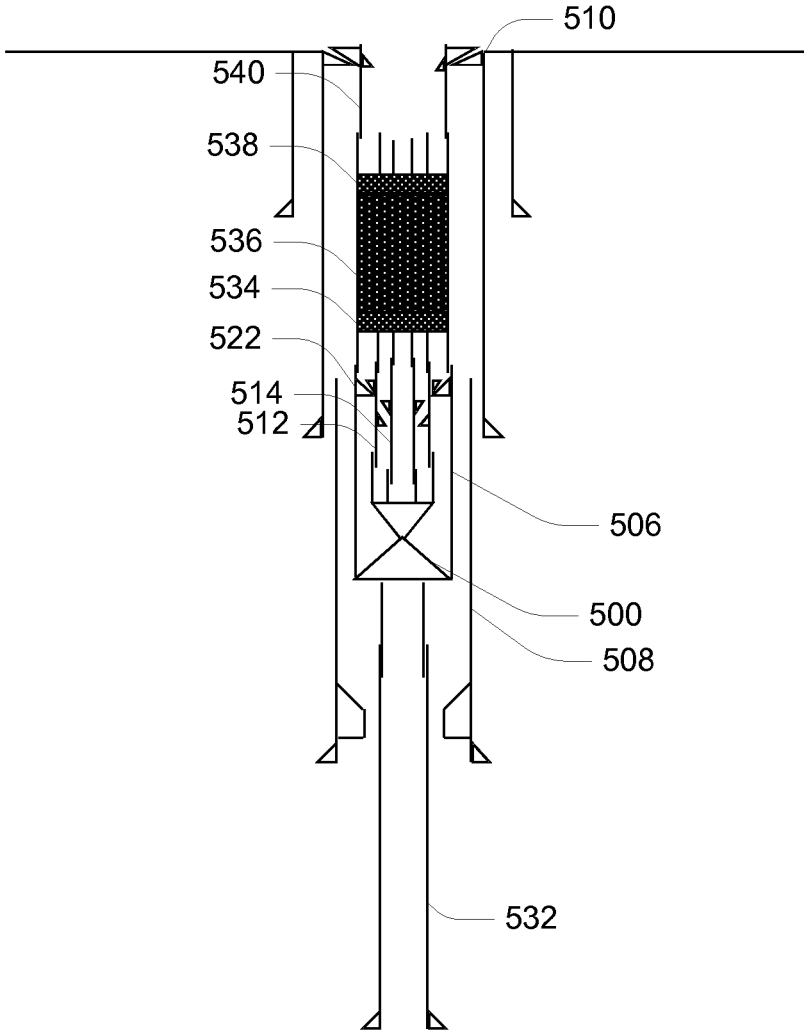
Figure 5H:
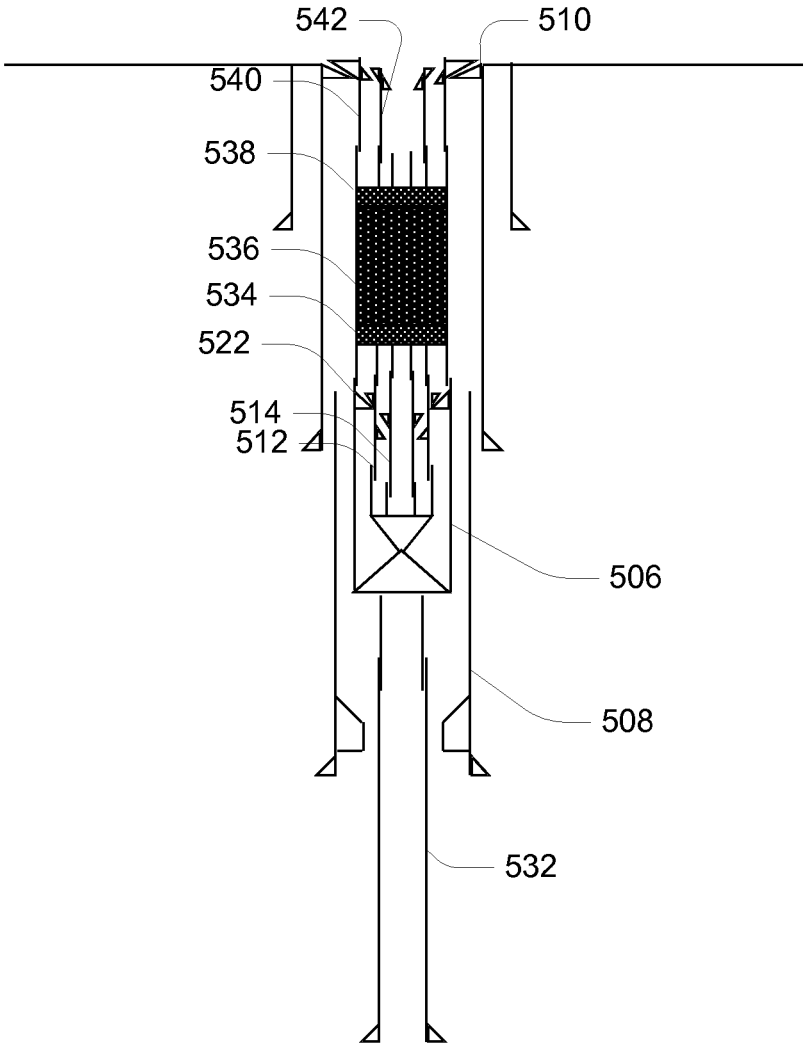
Figure 5I:
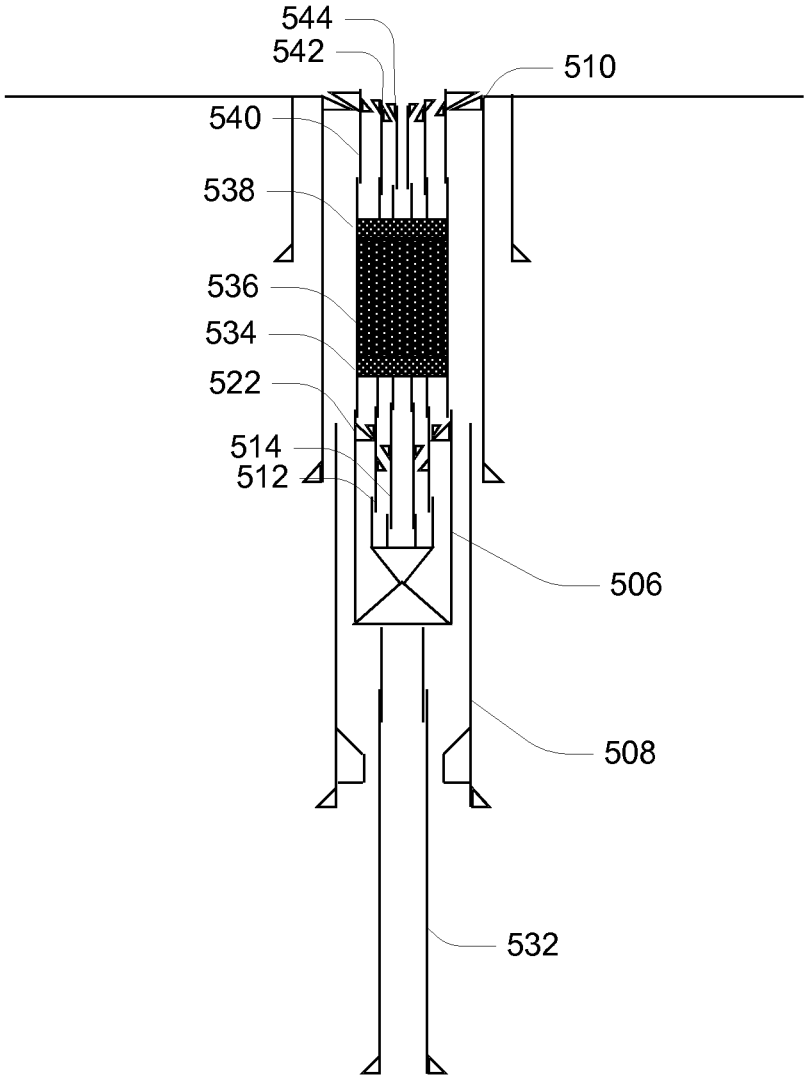

As depicted in FIG. 5*g*, an outer tubing string 540 of an upper concentric tubing string is installed. In FIG. 5*h*, an inner tubing string 542 of the upper concentric tubing string is installed. In FIG. 5*i*, another inner tubing string 542 is installed, thus completing the well completion system.

While the invention has been particularly shown and described with respect to exemplary embodiments thereof, it will be understood by those skilled in the art that changes in form and details may be made therein without departing from the scope and spirit of the invention.

What is claimed is:

1. A well completion system, comprising:

a concentric tubing string comprising an outermost tubing string and one or more concentric successive tubing strings, each successive tubing string defining an annular flow channel between an inner surface of a preceding tubing string and an outer surface of the successive tubing string, whereby a plurality of successive annular flow channels are defined that succeed from an outermost tubing string flow channel to an innermost tubing string flow channel;

a subsurface device having a plurality of distinct device flow channels that succeed from an outermost device flow channel to an innermost device flow channel, each device flow channel connected to a respective one of the tubing string flow channels; and a crossover comprising a plurality of concentric annular passages, at least one of which is fluidically coupled to at least one tubing string flow channel and a radially non-corresponding device flow channel, the crossover mechanically coupling the concentric tubing string to the subsurface device.

2. The well completion system of claim 1, wherein the crossover further comprises:

a first crossover flow channel fluidically coupling a first tubing string flow channel to a respectively outer device flow channel; and a second crossover flow channel fluidically coupling a second tubing string flow channel to a respectively inner device flow channel.

3. The well completion system of claim 2, wherein the crossover is an upper crossover connected to an upper portion of the subsurface device and the concentric tubing string is an upper concentric tubing string, the well completion system further comprising:

a lower concentric tubing string configured substantially the same as the upper concentric tubing string; and a lower crossover mechanically coupling the lower concentric tubing string to a lower portion of the subsurface device; the lower crossover comprising:

a third crossover flow channel fluidically coupling a first device flow channel to a respectively inner tubing string flow channel of the lower concentric tubing string; and a fourth crossover flow channel fluidically coupling a second device flow channel to a respectively outer tubing string flow channel of the lower concentric tubing string.

4. The well completion system of claim 3, wherein the first device flow channel and the respectively outer device flow channel are the same flow channel.

5. The well completion system of claim 3, wherein the second device flow channel and the respectively inner device flow channel are the same flow channel.

6. The well completion system of claim 3 wherein:

the lower concentric tubing string is coupled to the lower crossover at an upper portion of the lower concentric tubing string, and a fluidically driven pump is coupled to a lower end of the lower concentric tubing string.

7. The well completion system of claim 1, wherein the subsurface device is a heat exchanger.

8. The well completion system of claim 1, wherein the crossover is threadably coupled to the outermost tubing string of the concentric tubing string.

9. The well completion system of claim 1, wherein the crossover is slidably coupled to the one or more successive concentric tubing strings.

10. A subsurface heat exchanger section, comprising:

an outer tube including a sealing assembly and a receptacle;

an inner tube within the outer tube, the inner tube including a sealing assembly and a receptacle, an inner surface of the inner tube defining a central flow channel;

a heat exchange tube passing through an annular flow channel defined between an outer surface of the inner tube and an inner surface of outer tube, the heat exchange tube defining an isolated internal flow channel;

an upper plate and a lower plate sealably coupled at a respective each end of the inner tube and the outer tube, the heat exchange tube sealed at a respective end to the upper and lower plate; and an upper sealing collar and a lower sealing collar located on and surrounding an exterior surface of the outer tube, the exterior surface including one or more ports, into the annular flow channel.

11. The subsurface heat exchanger section of claim 10, wherein the subsurface heat exchanger section is fluidically coupled to a second subsurface heat exchanger section via a respective outer tube sealing assembly and outer tube receptacle and a respective inner tube sealing assembly and inner tube receptacle, and wherein the subsurface heat exchanger section is mechanically coupled to the second subsurface heat exchanger section via a concentric threaded collar coupled to respective sealing collars of the subsurface heat exchanger section and the second subsurface heat exchanger section.

12. The subsurface heat exchanger section of claim 10, wherein the exterior surface of the outer tube is an exterior annular surface, and wherein each port is formed through the outer tube and extends between the exterior annular surface of the outer tube and an interior annular surface of the outer tube.

* * * * *